US005863469A

United States Patent [19]

Haji et al.

[11] Patent Number: 5,863,469

[45] Date of Patent: Jan. 26, 1999

[54] ELECTRORHEOLOGICAL FLUID COMPRISING LYOTROPIC LIQUID CRYSTALLINE POLYMER AND A CYCLIC KETONE SOLVENT

[75] Inventors: Katsuhiko Haji; Makoto Sasaki; Mitsuo Matsuno, all of Kanagasa, Japan

[73] Assignee: Nippon Oil Company Co., Ltd, Tokyo, Japan

[21] Appl. No.: 823,537

[22] Filed: Mar. 25, 1997

[30] Foreign Application Priority Data

Mar. 26, 1996 [JP] Japan ..... 8-096188

[51] Int. Cl.[6] ..... C10M 171/00; H01B 3/20; H01B 3/22

[52] U.S. Cl. ..... 252/572; 252/73; 252/77; 252/79; 252/572

[58] Field of Search ..... 252/77, 73, 79, 252/572

[56] References Cited

U.S. PATENT DOCUMENTS

| | | | |
|---|---|---|---|
| 3,984,338 | 10/1976 | Vincent | 252/63.7 |
| 5,354,489 | 10/1994 | Inoue et al. | 252/73 |
| 5,536,428 | 7/1996 | Sasaki et al. | 252/77 |
| 5,679,280 | 10/1997 | Sasaki et al. | 252/77 |

FOREIGN PATENT DOCUMENTS

| | | |
|---|---|---|
| 0 478 034 A1 | 4/1992 | European Pat. Off. . |
| 0 625 565 A1 | 11/1994 | European Pat. Off. . |
| 0 670 363 A2 | 9/1995 | European Pat. Off. . |
| 42-11315 | 6/1942 | Japan . |
| 51-33783 | 3/1976 | Japan . |
| 53-93186 | 8/1978 | Japan . |
| 58-179259 | 10/1983 | Japan . |
| 61-44998 | 3/1986 | Japan . |
| 62-95397 | 5/1987 | Japan . |
| 4-191511 | 7/1992 | Japan . |
| 4-266997 | 9/1992 | Japan . |
| 6-330068 | 11/1994 | Japan . |
| 7-238290 | 9/1995 | Japan . |
| 1076754 | 7/1967 | United Kingdom . |

OTHER PUBLICATIONS

Tsutomu HONDA et al., "The Electroviscous Effect in the MBBA Liquid Crystal," *Japanese Journal of Applied Physics*, vol. 17, No. 9, Sep. 1978, pp. 1525–1530.

Y. Matsuo et al., "Electro–Rheological Properties of Polymeric Liquid Cristals," *Department of Polymer Chemistry, Kyoto University, Kyoto 606*, 1990, pp. 82–83.

Paul Doty et al., "Polypeptides. IV. The Molecular Weight, Configuration and Association of Poly–γ–benzyl–L–glutamate in Various Solvents," *Molecular Association of Poly–γ–Benzyl–L–Glutamate*, Mar. 5, 1956, pp. 947–954.

*Primary Examiner*—Paul Lieberman
*Assistant Examiner*—Charles Boyer
*Attorney, Agent, or Firm*—Morgan, Lewis & Bockius LLP

[57] ABSTRACT

An electrorheological fluid comprising a lyotropic liquid crystalline polymer uniformly dissolved in a cyclic ketone solvent or a mixed solvent of a cyclic ketone solvent and at least one electrically insulating solvent selected from a hydrocarbon-based oil, an ester-based oil, and an ether-based oil.

11 Claims, No Drawings

ELECTRORHEOLOGICAL FLUID COMPRISING LYOTROPIC LIQUID CRYSTALLINE POLYMER AND A CYCLIC KETONE SOLVENT

FIELD OF THE INVENTION

This invention relates to an electrorheological fluid whose viscosity can be controlled by application of an electric field.

BACKGROUND OF THE INVENTION

An electrorheological fluid (i.e., a fluid having an electroviscous effect) is known as a suspension of inorganic or polymeric particles in an electrically insulating liquid, which changes its viscosity rapidly and reversibly from a liquid state to a plastic state or a solid state or vice versa on application of an electric field. This phenomenon is called a Winslow effect.

Dispersion particles whose surface is readily depolarizable under an electric field are usually used in an electrorheological fluid. For example, inorganic dispersion particles include silica as disclosed in U.S. Pat. No. 3,047,507, British Patent 1,076,754 and JP-A-61-44998 (the term "JP-A" as used herein means an "unexamined published Japanese patent application"), and zeolite as disclosed in JP-A-62-95397. Polymeric dispersion particles include alginic acid, glucose having carboxyl groups, and glucose having sulfone groups as disclosed in JP-A-51-33783, polyacrylic acid crosslinked with divinylbenzene as disclosed in JP-A-53-93186, and a resol type phenolic resin as disclosed in JP-A-58-179259.

The electrically insulating fluid includes hydrocarbon-based oils, silicone oils, ester-based oils, and fluorohydrocarbon-based oils.

Application of the electrorheological fluid to engine mounts, shock absorbers, clutches, etc. can be expected.

However, any of the conventionally known electrorheological fluids are of disperse system, they cannot get rid of the problem that the dispersion particles are to separate and precipitate, which has been a main obstacle to practical application of the electrorheological fluid.

Attempts have been made to develop a homogeneous electrorheological fluid. For example, an electrorheological fluid containing low-molecular liquid crystals, such as methoxybenzylidenebutylaniline, has been studied (see *Japanese Journal of Applied Physics,* Vol. 17, p. 1525 (1978)), but is still unsuitable for practical use because of its very small electrorheological effect.

JP-B-42-11315 (the term "JP-B" as used herein means an "examined published Japanese patent application") discloses that a uniform solution containing high-molecular liquid crystals exhibits an electrorheological effect. It has been reported that a great electrorheological effect is obtained from a solution of poly(γ-benzyl L-glutamate), which is known as a lyotropic liquid crystalline polymer, in a low-boiling polar solvent, such as dioxane, tetrahydrofuran or cresol, or a low-boiling chlorine-containing solvent, such as methylene chloride or chloroform, as disclosed in JP-A-4-191511, JP-A-4-266997, and *Dai-16kai Ekisyo Toronkai Yokoshu,* p. 82 (1990). Further, JP-A-6-330068 and JP-A-7-238290 describe that a great electrorheological effect is obtained from an α-methylphthalene solution of poly(γ-benzyl L-glutamate-co-γ-dodecyl L-glutamate) having improved solubility in an aromatic solvent.

The above-described electrorheological fluid using poly (γ-benzyl L-glutamate) has a homogeneous system and can therefore be freed of precipitation of particles and also exhibits a relatively great electrorheological effect. Solvents proposed for dissolving poly(γ-benzyl L-glutamate) include low-boiling polar solvents and low-boiling chlorine-containing solvents. However, these electrorheological fluids are still difficult to put into practical use due to different problems arising from the solvent, such as an electrical current readily runs therethrough; the electrodes are susceptible to corrosion; the solvent readily evaporates; the solvent has high toxicity. In addition, as the molecular weight of the poly(γ-benzyl L-glutamate-co-γ-dodecyl L-glutamate) increases, it becomes less soluble in an aromatic solvent, and the resulting solution has an increased viscosity before application of an electric field, making the difference in torque induced on application of an electric field smaller.

SUMMARY OF THE INVENTION

An object of the present invention is to provide an electrorheological fluid of homogeneous system free from precipitation of particles, which hardly allows electricity to pass therethrough and has a small viscosity with no applied electric field thereby producing a large difference in torque on application of an electric field.

As a result of extensive study, the inventors of the present invention have found that the above object is accomplished by a uniform solution of a lyotropic liquid crystalline polymer in a solvent containing a cyclic ketone and reached the invention based on this finding.

The present invention provides an electrorheological fluid comprising a lyotropic liquid crystalline polymer uniformly dissolved in a cyclic ketone solvent or a mixed solvent of a cyclic ketone solvent and at least one electrically insulating solvent selected from a hydrocarbon-based oil, an ester-based oil, and an ether-based oil.

DETAILED DESCRIPTION OF THE INVENTION

The lyotropic liquid crystalline polymer for use in the invention includes poly(γ-glutamate)s, polyamino acids, polyisocyanates, polysiloxane esters, aromatic polyesters, poly(β-aspartate)s, aromatic polyamide, cellulose or derivatives thereof, polyamidohydrazine, polyhydrazine, polyphosphagen, amphiphatic block copolymers, ribonucleic acid, deoxyribonucleic acid, polyacrylic esters, and polymethacrylic esters.

Preferred of them are poly(γ-glutamate)s, polyisocyanates, and polyamino acids. Still preferred of poly(γ-glutamate)s are those having constituent units represented by formulae (1) and.(2):

$$-(NH-\underset{\substack{|\\ C_2H_4-COO-R_1}}{CH}-CO)_m- \quad (1)$$

$$-(NH-\underset{\substack{|\\ C_2H_4-COO-R_2}}{CH}-CO)_n- \quad (2)$$

wherein $R_1$ represents an alkyl group having 1 to 7 carbon atoms, an aralkyl group having 7 carbon atoms, an aryl group having 6 or 7 carbon atoms, a cycloalkyl group having 3 to 7 carbon atoms, or a mixed group of at least two thereof; $R_2$ represents an alkyl group, an aralkyl group, an aryl group, a cycloalkyl group, an oleyl group, or a mixed group of at least two thereof, each of which has 8 to 30 carbon atoms; m represents 1 to 6500; n represents 1 to 5000; provided that n/m is 95/5 to 5/95.

Specific examples of $R_1$ are an alkyl group, e.g., methyl, ethyl, propyl, butyl, pentyl or hexyl; an aryl group, e.g., phenyl; an aralkyl group, e.g., benzyl; and a cycloalkyl group, e.g., cyclohexyl. $R_1$ is preferably a methyl group or a benzyl group. The plural $R_1$ groups in the polymer may be the same or different.

Specific examples of $R_2$ are an alkyl group, e.g., octyl, nonyl, decyl or dodecyl; an aralkyl group, e.g., butylbenzyl; an aryl group, e.g., butylphenyl; a cycloalkyl group, e.g., butylcyclohexyl; and an oleyl group. $R_2$ is preferably an octyl group, a decyl group, a dodecyl group, or an oleyl group. A dodecyl group or an oleyl group is particularly preferred for solubility. The plural $R_2$ groups in the polymer may be the same or different.

The liquid crystalline polymer used in the invention preferably has a weight average molecular weight of 500 to 1,500,000, particularly 1000 to 1,000,000. If the molecular weight is less than 500, the electrorheological effect produced is insufficient. If it exceeds 1,500,000, the solubility in the solvent is reduced.

The molecular weight (degree of polymerization) of the liquid crystalline polymer is determined by measuring the viscosity of the polymer with a Ubbelohde's viscometer in dichloroacetic acid at 25° C. and substituting the viscosity for [η] of the following equation (see P. Doty, J. H. Bradbury & A. M. Holtzer, *J. Amer. Chem. Soc.,* Vol. 78, p. 947 (1956)).

$$[\eta]=2.7\times10^{-5}Mw^{0.87}$$

The electrically insulating solvent for use in the invention is at least one solvent selected from a hydrocarbon-based oil, an ester-based oil, and an ether-based oil. A solvent selected from a hydrocarbon-based oil and an ester-based oil is still preferred. A hydrocarbon-based oil is particularly preferred. The solvent preferably has a boiling point of 150° C. or higher. A solvent whose boiling point is below 150° C. readily evaporates. The hydrocarbon-based oil includes mineral oil, an alkylbenzene, an alkylnaphthalene, and a poly-α-olefin. The ester-based oil includes dibutyl phthalate, dioctyl phthalate, and dibutyl sebacate. The ether-based oil includes oligophenylene oxide.

The cyclic ketones which can be used in the invention include those having a norbornene skeleton and those having no norbornene skeleton. The former is preferred. Examples of the former are 8-ketotricyclo[5.2.1.0$^{2,6}$]decane, camphor, and fenchone. Examples of the latter are 2-(1'-cyclohexenyl) cyclohexanone, 2-decalone, α-tetralone, β-tetralone, isophorone, menthone, 2-adamantanone, 1-benzosuberone, dibenzosuberone, dihydrocarvone, and indanone.

These cyclic ketones preferably have a boiling point of 150° C. or higher. Those having a boiling point below 150° C. readily evaporate. The cyclic ketones may be solid at room temperature as far as they are soluble in the electrically insulating solvent.

The cyclic ketone solvent may be used either alone or in combination with the electrically insulating solvent. When used in combination with the electrically insulating solvent, the ratio of the electrically insulating solvent is preferably not more than 99% by weight, particularly 10 to 95% by weight, especially 20 to 80% by weight, based on the cyclic ketone. The electrically insulating solvent, when used alone, has too high a viscosity with no electric field applied.

The liquid crystalline polymer is used in a concentration of 0.1 to 80% by weight, preferably 0.5 to 60% by weight, in the cyclic ketone solvent or a mixed solvent of the cyclic ketone solvent and the electrically insulating solvent. If the concentration is less than 0.1%, a sufficient electrorheological effect cannot be obtained. If it exceeds 80%, the initial viscosity with no electric field applied is too high for practical use. The fluid having uniformly dissolved therein the lyotropic liquid crystalline polymer does not always need to exhibit a liquid crystal phase. A sufficient electrorheological effect would be exerted even at such a low concentration as shows no liquid crystal phase.

As described above, the uniform electrorheological fluid according to the present invention is a homogeneous system in which a lyotropic liquid crystalline polymer is uniformly dissolved in a cyclic ketone or a mixed solvent of a cyclic ketone and an electrically insulting solvent. It is free from precipitation of particles and exhibits an excellent electrorheological effect, producing a great change in torque on application of an electric field.

The electrorheological fluid of the invention is applicable to engine mounts, damping apparatus (e.g., shock absorbers), clutches, torque converters, brake systems, valves, dampers, suspensions, actuators, vibrators, ink jet printers, and the like.

The present invention will now be illustrated in greater detail by referring to Examples, but the present invention is not construed as being limited thereto.

SYNTHESIS EXAMPLE

Dichloroethane (2 l) and 15 g of p-toluenesulfonic acid were mixed, and the mixture was refluxed at 115° C. for 4 hours to remove water from the system. In the mixed solution was completely dissolved 30 g of poly(γ-benzyl L-glutamate) (molecular weight: 260,000, prepared by polymerizing γ-benzyl L-glutamate N-carboxyamino acid anhydride using triethylamine as a catalyst). To the solution was added 510 g of dodecyl alcohol, followed by refluxing in dichloroethane for 24 hours to conduct ester interchange. After completion of the reaction, the reaction mixture was poured into a large quantity of methanol to reprecipitate the polymer, which was collected by filtration, washed with methanol and re-dissolved in dichloroethane. The above purification step was repeated four more times. The finally collected polymer was dried at 80° C./2 mmHg to obtain 34 g of the purified polymer (designated polymer P). NMR analysis revealed that polymer P was poly(γ-benzyl L-glutamate-co-γ-dodecyl L-glutamate), in which 72% of the benzyl groups of the starting polymer had been replaced with dodecyl groups.

EXAMPLE 1

In a mixed solvent of 6.86 g of α-methylnaphthalene and 2.94 g of 8-ketotricyclodecane was dissolved 0.2 g of polymer P to prepare an electrorheological fluid (designated fluid (1)). The torque of fluid (1) was measured with a rotating spindle viscometer (inner cylinder diameter: 16 mm; outer cylinder diameter: 18 mm) equipped with an electric field applicator under conditions of an applied voltage of 5 kV/mm, a shear rate of 200 $s^{-1}$, and a temperature of 25° C. The electric current was also measured. The results obtained are shown in Table 1 below. In the Table, the "initial torque" is the one before application of an electric field, and the "rate of change" in torque means the rate of the torque under application of 5 kV to the initial torque.

EXAMPLE 2

In a mixed solvent of 6.86 g of α-methylnaphthalene and 2.94 g of camphor was dissolved 0.2 g of polymer P to prepare an electrorheological fluid (designated fluid (2)). The torque and the current of fluid (2) were measured in the same manner as in Example 1, and the results are shown in Table 1.

EXAMPLE 3

In a mixed solvent of 5.76 g of α-methylnaphthalene and 3.84 g of 8-ketotricyclodecane was dissolved 0.4 g of polymer P to prepare an electrorheological fluid (designated fluid (3)). The torque and the current of fluid (3) were measured in the same manner as in Example 1, and the results are shown in Table 1.

EXAMPLE 4

In 9.85 g of 8-ketotricyclodecane was dissolved 0.15 g of poly(γ-benzyl L-glutamate) (molecular weight: 260,000, prepared by polymerizing γ-benzyl L-glutamate N-carboxyamino acid anhydride using triethylamine as a catalyst) to prepare an electrorheological fluid (designated fluid (4)). The torque and the current of fluid (4) were measured in the same manner as in Example 1, and the results are shown in Table 1.

COMPARATIVE EXAMPLE 1

In 9.8 g of α-methylnaphthalene was dissolved 0.2 g of polymer P to prepare an electrorheological fluid (designated fluid (5)). The torque and the current of fluid (5) were measured in the same manner as in Example 1, and the results are shown in Table 1.

COMPARATIVE EXAMPLE 2

In 9.6 g of α-methylnaphthalene was dissolved 0.4 g of polymer P to prepare an electrorheological fluid (designated fluid (5)). The torque and the current of fluid (6) were measured in the same manner as in Example 1, but precise measurement could not be made because the fluid had high thixotropy and was caught up around the rotor.

COMPARATIVE EXAMPLE 3

It was tried in vain to dissolve 0.15 g of the poly(γ-benzyl L-glutamate) used in Example 4 in 9.85 g of α-methylnaphthalene.

TABLE 1

| | Electrorheological Fluid | Initial Torque (g · cm) | Torque with 5 kV Applied (g · cm) | Rate of Change (time) | Current (μA) |
|---|---|---|---|---|---|
| Example 1 | (1) | 10 | 89 | 8.9 | 357 |
| Example 2 | (2) | 13 | 119 | 9.2 | 323 |
| Example 3 | (3) | 29 | 200 | 6.9 | 1020 |
| Example 4 | (4) | 7 | 43 | 6.1 | 1925 |
| Compara. Example 1 | (5) | 22 | 112 | 5.1 | 204 |
| Compara. Example 2 | (6) | unmeasurable | unmeasurable | unmeasurable | unmeasurable |
| Compara. Example 3 | not dissolved | | | | |

As is apparent from Table 1, use of a cyclic ketone solvent provides an electrorheological fluid having a reduced initial torque with no electric field applied and producing a greater difference in torque on application of an electric field as compared with an electrorheological fluid using a hydrocarbon solvent alone. While the electrorheological fluid comprising a polymer in a high concentration and a hydrocarbon solvent alone has poor flowability due to high thixotropy, addition of a cyclic ketone solvent provides satisfactory flowability.

As described above, the uniform electrorheological fluid according to the present invention is a homogeneous system in which a lyotropic liquid crystalline polymer is iiuniformly dissolved in a cyclic ketone solvent or a mixed solvent of a cyclic ketone solvent and an electrically insulting solvent. It is free from precipitation of particles and exhibits an excellent electrorheological effect, producing a great change in torque on application of an electric field.

The electrorheological fluid of the invention is applicable to engine mounts, shock absorbers, clutches, torque converters, brake systems, valves, dampers, suspensions, actuators, vibrators, ink jet printers, and the like and is of great industrial utility.

While the invention has been described in detail and with reference to specific examples thereof, it will be apparent to one skilled in the art that various changes and modifications can be made therein without departing from the spirit and scope thereof.

What is claimed is:

1. An electrorheological fluid comprising a lyotropic liquid crystalline polymer uniformly dissolved in (i) a cyclic ketone solvent or (ii) a mixed solvent comprising (a) at least about 30% by weight of a cyclic ketone solvent (10) and at least one electrically insulating solvent selected from the group consisting of a hydrocarbon-based oil, an ester-based oil and an ether-based oil.

2. An electrorheological fluid according to claim 1, wherein said lyotropic liquid crystalline polymer is at least one polymer selected from the group consisting of a poly (γ-glutamate), a polyamino acid and a polyisocyanate.

3. An electrorheological fluid according to claim 2, wherein said poly(γ-glutamate) comprises constituent units represented by formulae (1) and (2):

$$-(NH-\underset{\underset{C_2H_4-COO-R_1}{|}}{CH}-CO)_m- \quad (1)$$

$$-(NH-\underset{\underset{C_2H_4-COO-R_2}{|}}{CH}-CO)_n- \quad (2)$$

wherein $R_1$ represents an alkyl group having 1 to 7 carbon atoms, an aralkyl group having 7 carbon atoms, an aryl group having 6 or 7 carbon atoms, a cycloalkyl group having 3 to 7 carbon atoms, or a mixed group of at least two thereof; $R_2$ represents an alkyl group, an aralkyl group, an aryl group, a cycloalkyl group, an oleyl group, or a mixed group of at least two thereof, each of which has 8 to 30 carbon atoms; m represents 1 to 6500; n represents 1 to 5000; provided that n/m is 95/5 to 5/95.

4. An electrorheological fluid according to claim 1, wherein said cyclic ketone has a norbornene skeleton.

5. An electrorheological fluid according to claim 1, wherein said electrically insulating solvent is a hydrocarbon-based oil.

6. An electrorheological fluid according to claim 1, wherein said liquid crystalline polymer is present in a concentration ranging from 0.1 to 80% by weight.

7. An electrorheological fluid according to claim 6, wherein said liquid crystalline polymer is present in a concentration ranging from 0.5 to 60% by weight.

8. An electrorheblogical fluid according to claim 1, wherein said electrically insulating solvent is present at no more than 99% by weight based on the cyclic ketone.

9. An electrorheological fluid according to claim 8, wherein said electrically insulating solvent is present in an amount ranging from 10 to 95% by weight based on the cyclic ketone.

10. An electrorheological fluid according to claim 9, wherein said electrically insulating solvent is present in an amount ranging from 20 to 80% by weight based on the cyclic ketone.

11. An electrorheological fluid according to claim 1, wherein the rate of change in torque of the fluid under application of 5 kv is at least 6 g.cm.

* * * * *